US011372356B2

(12) United States Patent
Lee et al.

(10) Patent No.: US 11,372,356 B2
(45) Date of Patent: Jun. 28, 2022

(54) COLOR REGISTRATION USING NOISE FREE DATA

(71) Applicant: HEWLETT-PACKARD DEVELOPMENT COMPANY, L.P., Spring, TX (US)

(72) Inventors: Kyung Ha Lee, Pangyo (KR); Seok Heon Chae, Pangyo (KR); Yun Su Kim, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/049,894

(22) PCT Filed: Oct. 15, 2018

(86) PCT No.: PCT/KR2018/012079
§ 371 (c)(1),
(2) Date: Oct. 22, 2020

(87) PCT Pub. No.: WO2019/231060
PCT Pub. Date: Dec. 5, 2019

(65) Prior Publication Data

US 2021/0080890 A1 Mar. 18, 2021

(30) Foreign Application Priority Data

May 31, 2018 (KR) ..... 10-2018-0063013

(51) Int. Cl.
*G03G 15/01* (2006.01)
*G03G 15/00* (2006.01)

(52) U.S. Cl.
CPC ..... *G03G 15/5058* (2013.01); *G03G 15/0131* (2013.01)

(58) Field of Classification Search
CPC ..... G03G 15/5058
(Continued)

(56) References Cited

U.S. PATENT DOCUMENTS 7,658,462 B2 2/2010 Eom
8,009,320 B2 8/2011 Bae
(Continued)

FOREIGN PATENT DOCUMENTS

EP 1615083 1/2006
EP 1717048 11/2006
(Continued)

OTHER PUBLICATIONS

Hata. Translation of JP 2000137367 A. Published May 2000. Translated Mar. 2021. (Year: 2000).*
(Continued)

*Primary Examiner* — Walter L Lindsay, Jr.
*Assistant Examiner* — Philipmarcus T Fadul
(74) *Attorney, Agent, or Firm* — Staas & Halsey LLP

(57) ABSTRACT

Provided is an operation method of an image forming apparatus, the operation method including according to a color registration pattern that is a standard for determining an overlapping degree of respective color images of a plurality of colors to form a color image, transferring respective developers with the plurality of colors onto an intermediate transfer body; obtaining patch data of patches of the plurality of colors transferred according to the color registration pattern onto the intermediate transfer body. The patch data is compared with reference patch data corresponding to the color registration pattern, and based on a result of the comparing, noise data corresponding to noise is detected from the patch data. Standard patch data is obtained by removing the noise data from the patch data, and performing color registration based on the standard patch data.

15 Claims, 11 Drawing Sheets

(58) Field of Classification Search
USPC ..... 399/39
See application file for complete search history.

(56) References Cited

U.S. PATENT DOCUMENTS

| | | | | |
|---|---|---|---|---|
| 2010/0053638 | A1* | 3/2010 | Murayama ..... | G03G 15/0194 356/620 |
| 2014/0169842 | A1 | 6/2014 | Nakashima | |
| 2015/0023702 | A1 | 1/2015 | Cho et al. | |

FOREIGN PATENT DOCUMENTS

| | | |
|---|---|---|
| EP | 1956828 | 8/2008 |
| JP | 2000137367 | 5/2000 |
| JP | 2000162836 | 6/2000 |
| JP | 2001265086 | 9/2001 |

OTHER PUBLICATIONS

Aso. Translation of JP 2001265086 A. Published Sep. 2001. Translated Mar. 2021. (Year: 2001).*
Yoshizawa. Translation of JP 2000162836 A. Published Jun. 2000. Translated Mar. 2021. (Year: 2000).*

* cited by examiner

[Fig. 1]
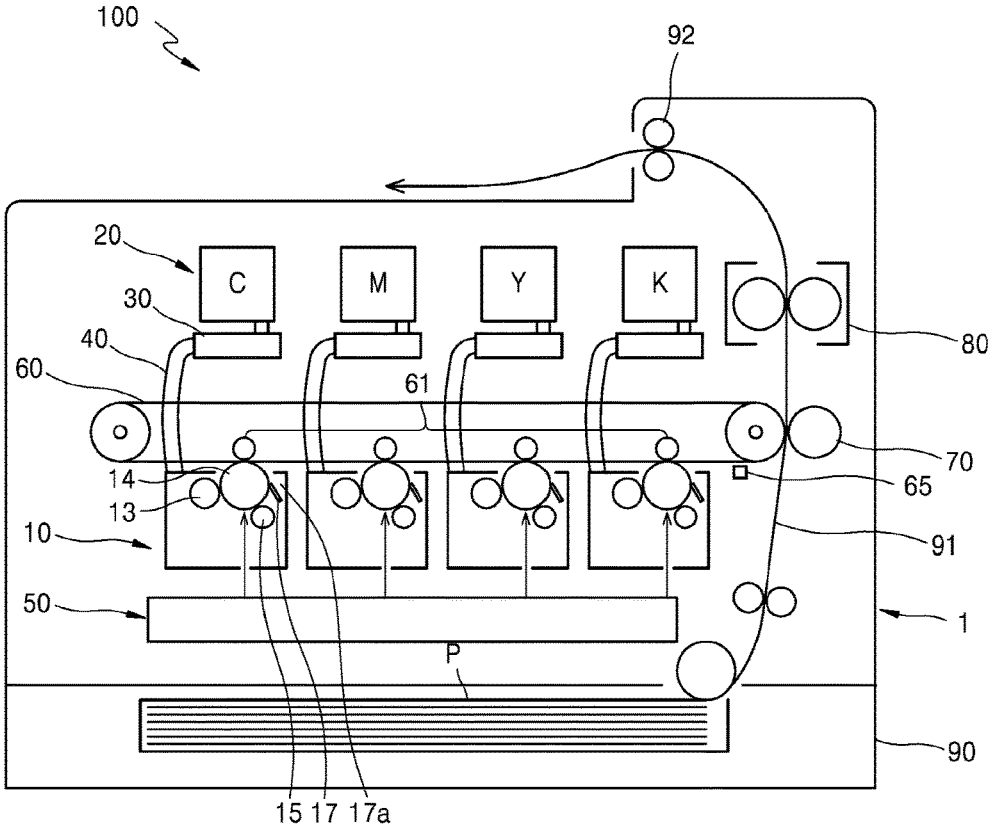
[Fig. 2]
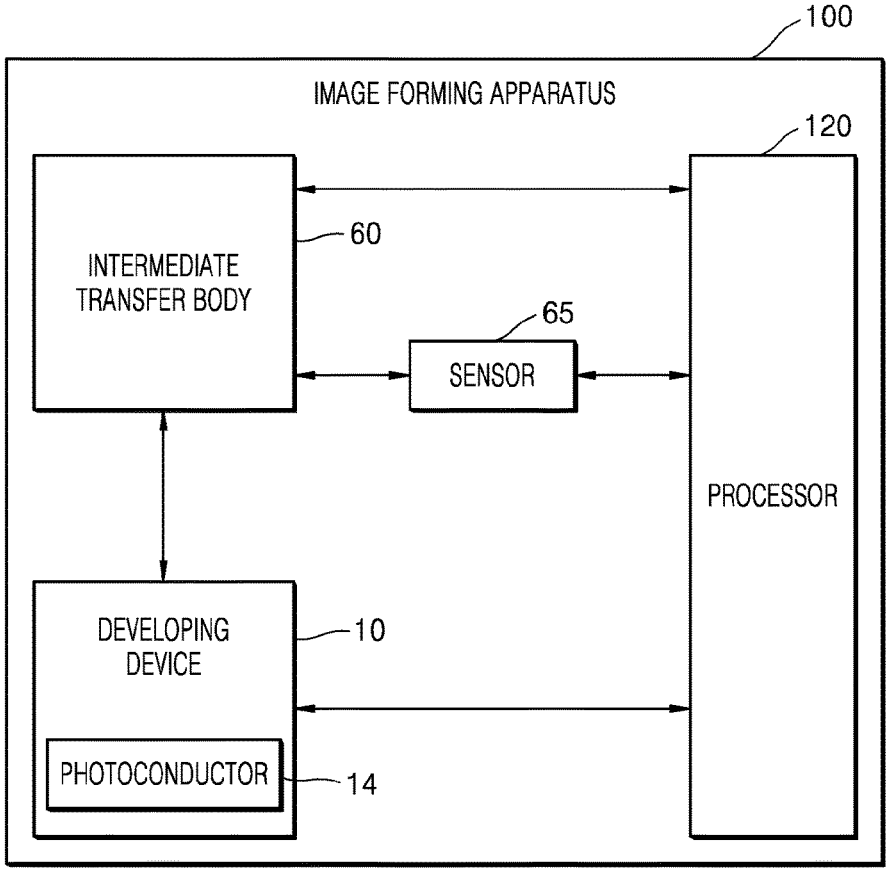

[Fig. 3]
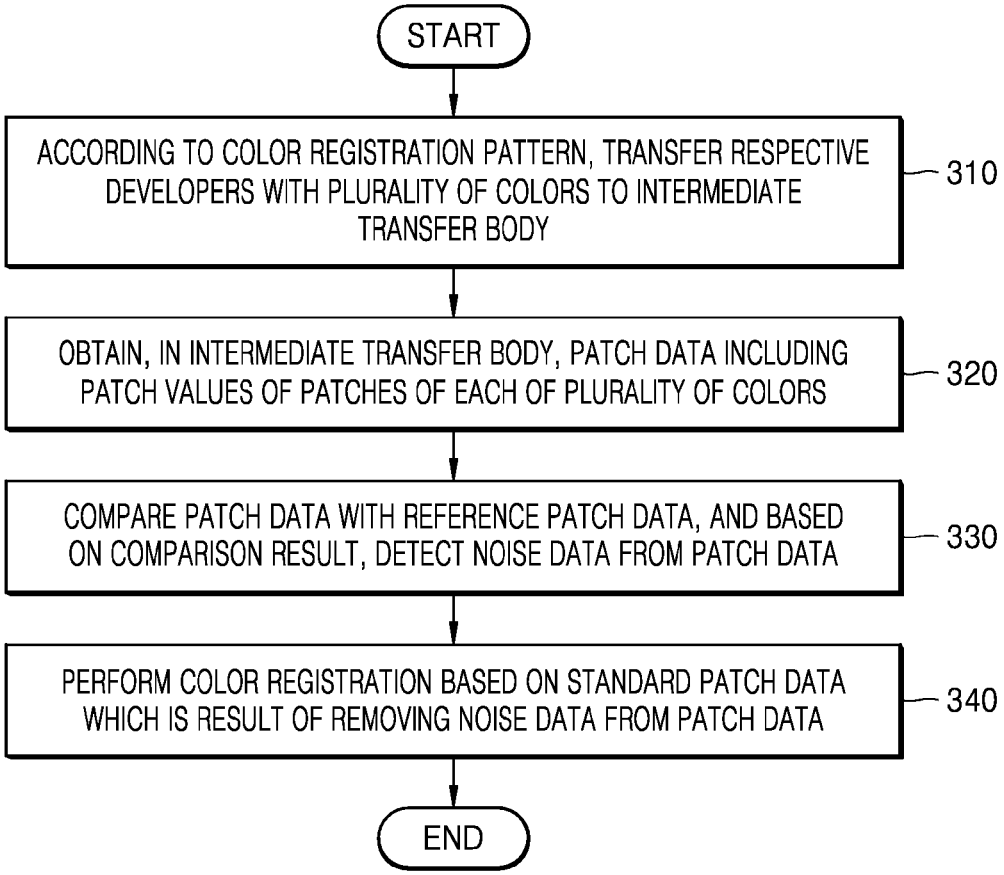

[Fig. 4]
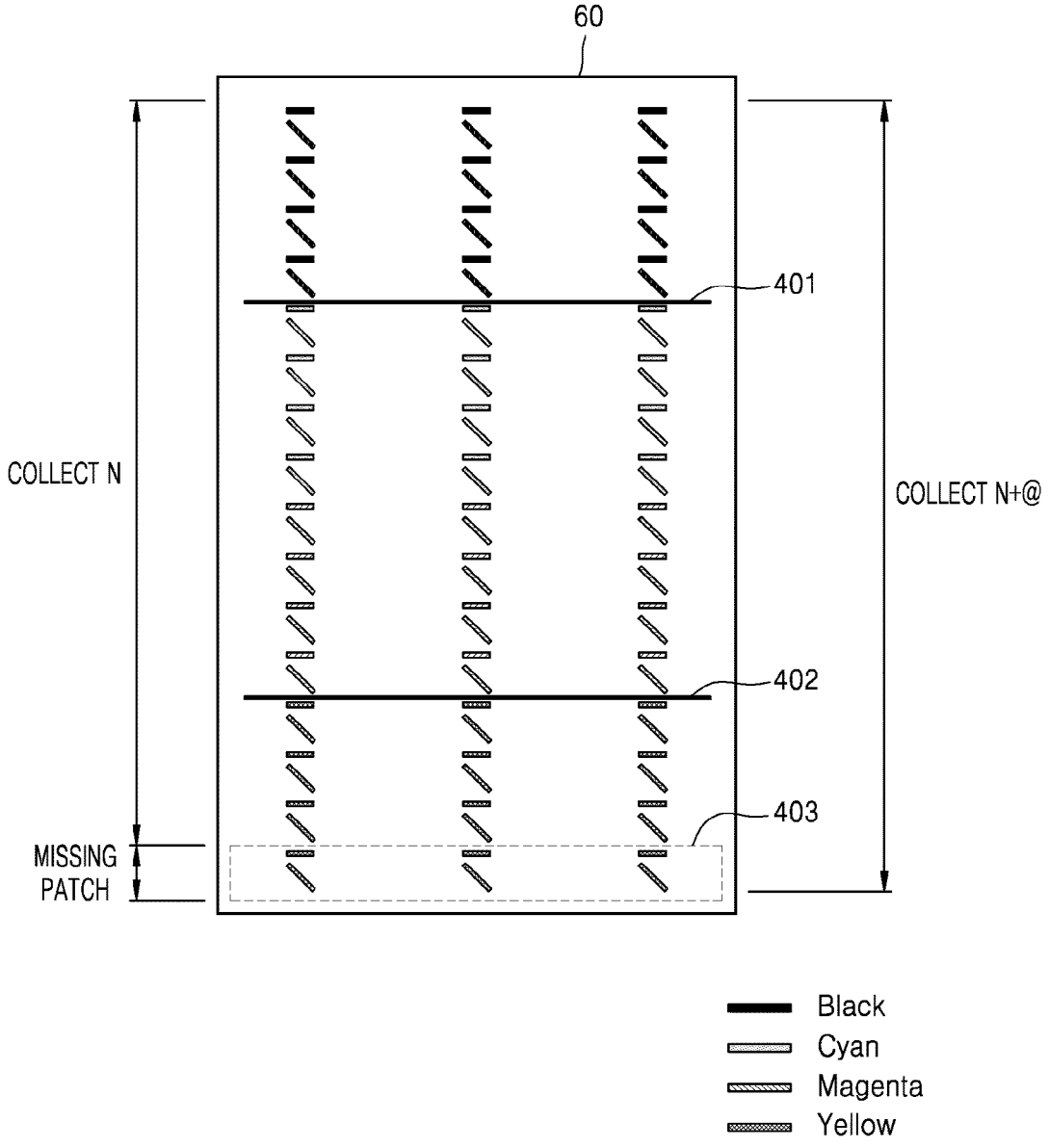

[Fig. 5]
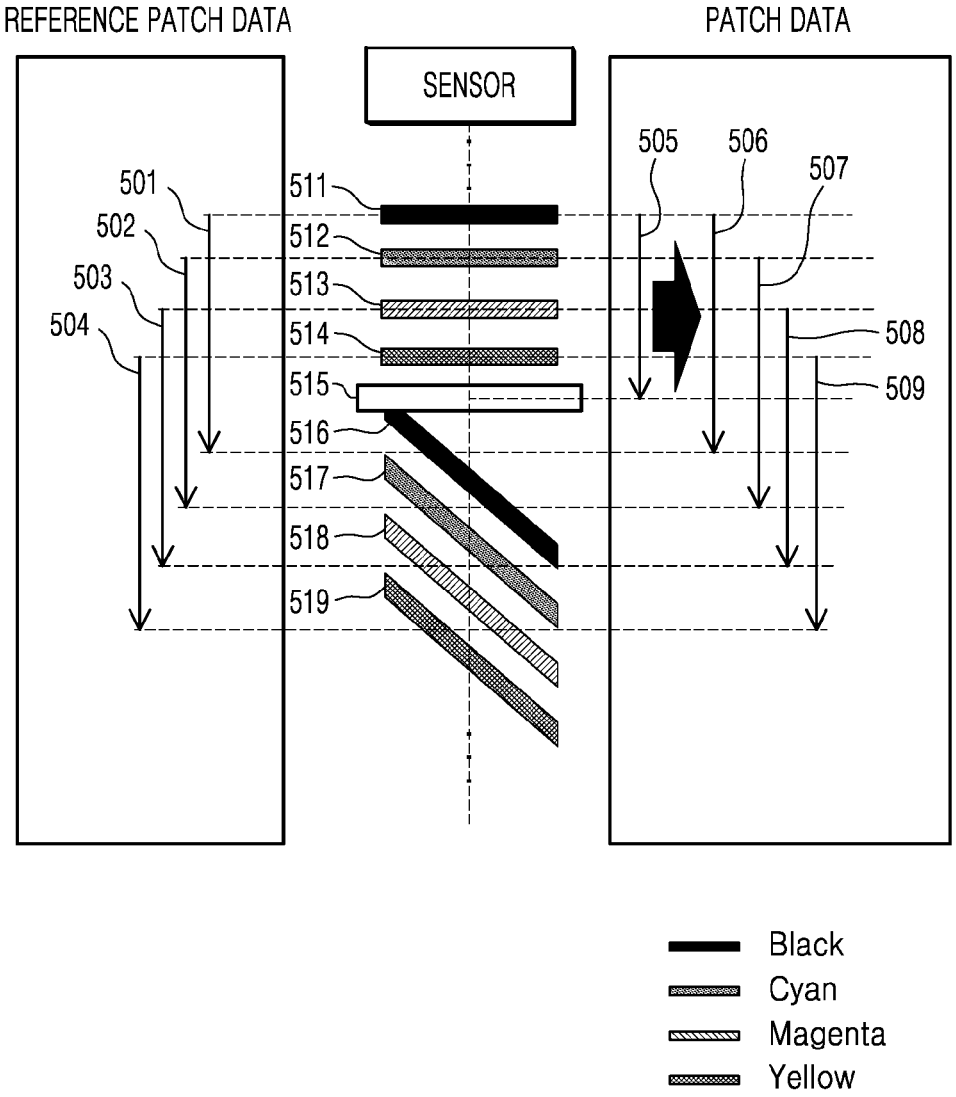

[Fig. 6]
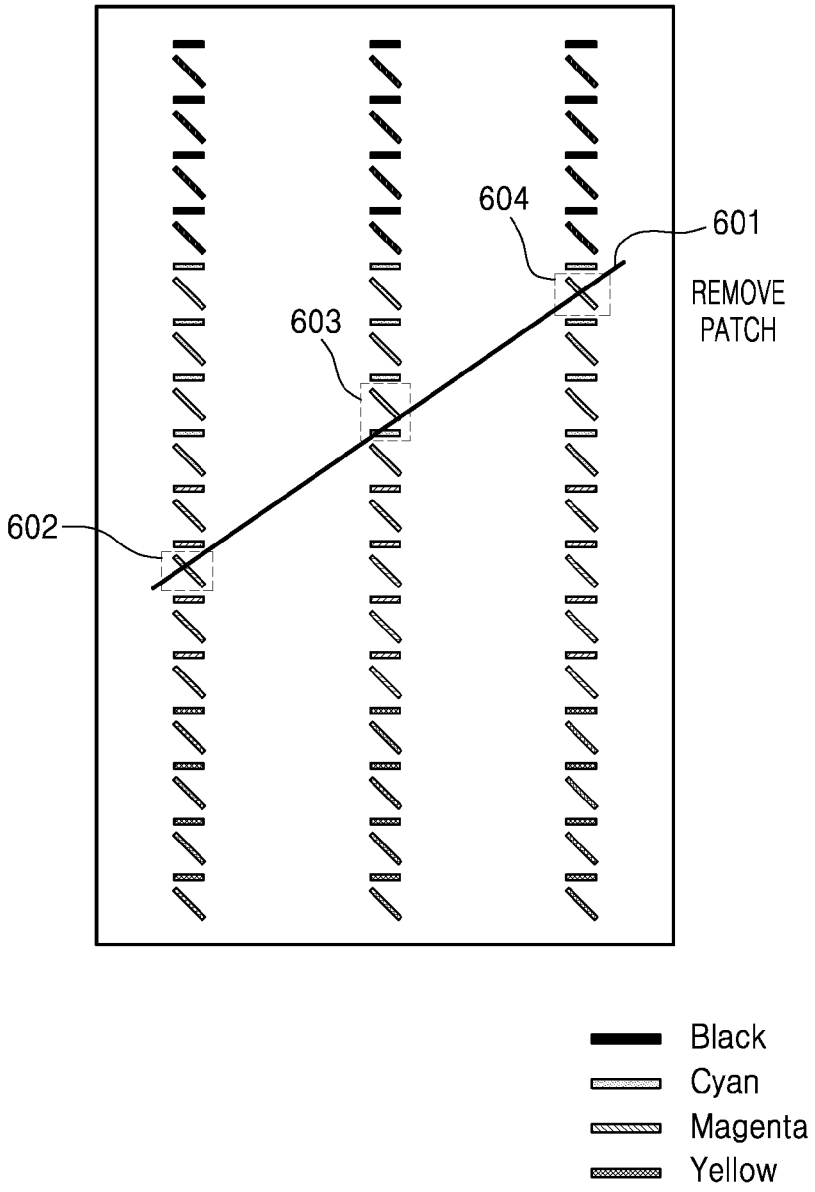

[Fig. 7]
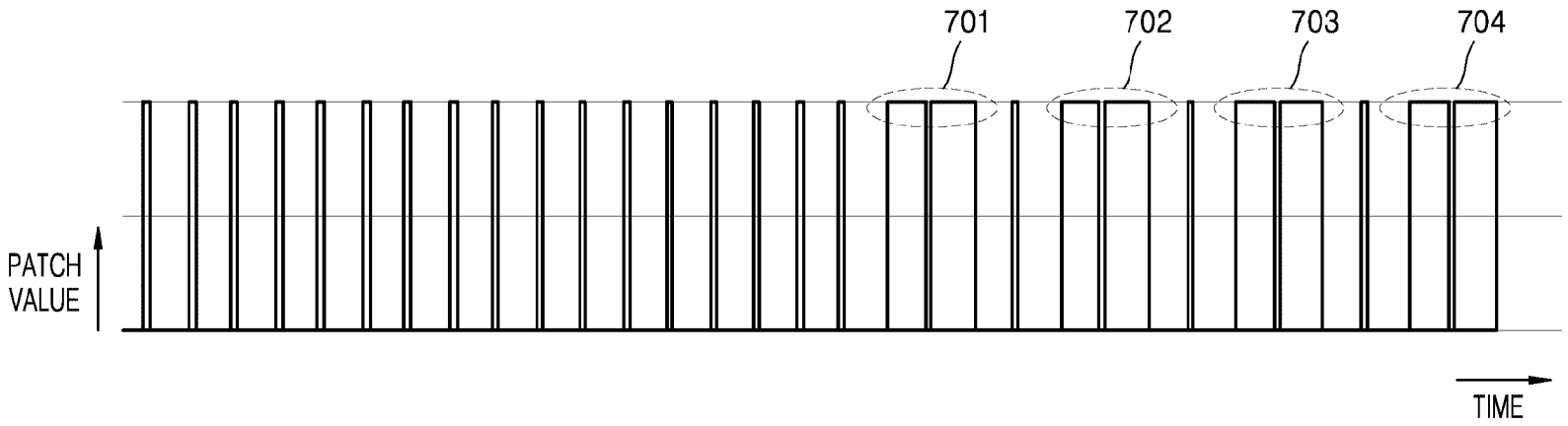

[Fig. 8]
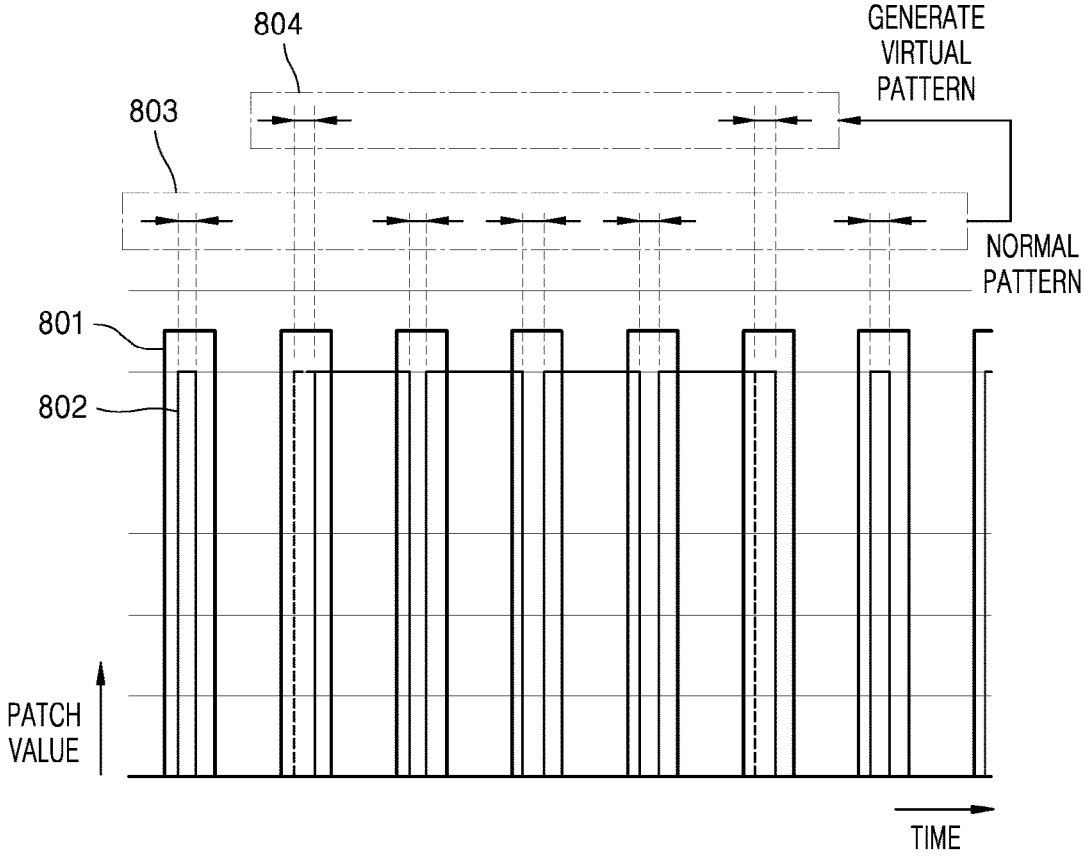

[Fig. 9]
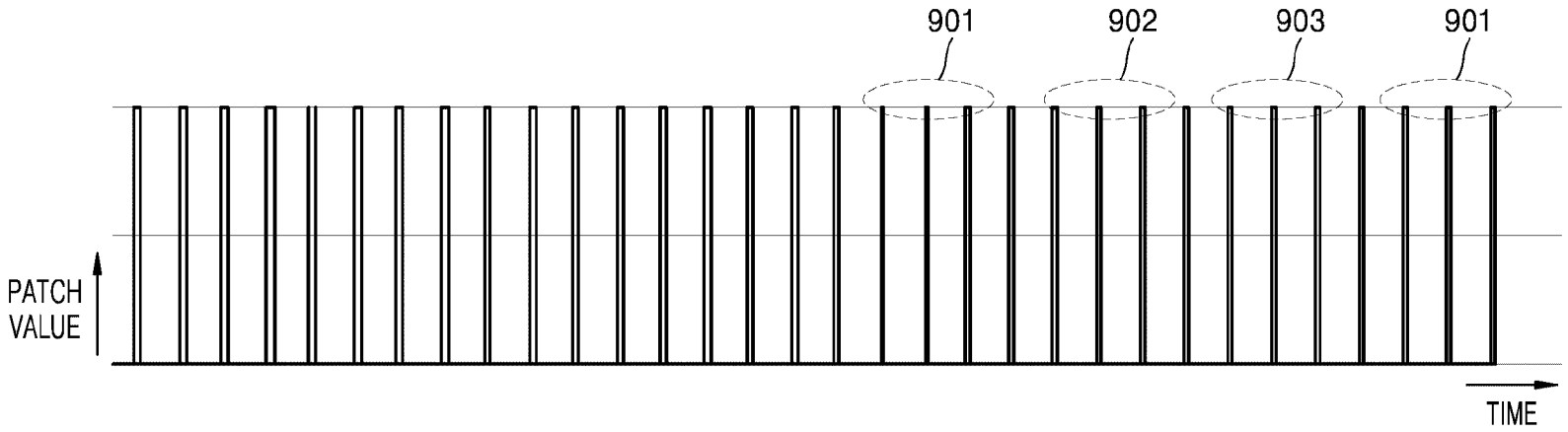

[Fig. 10]
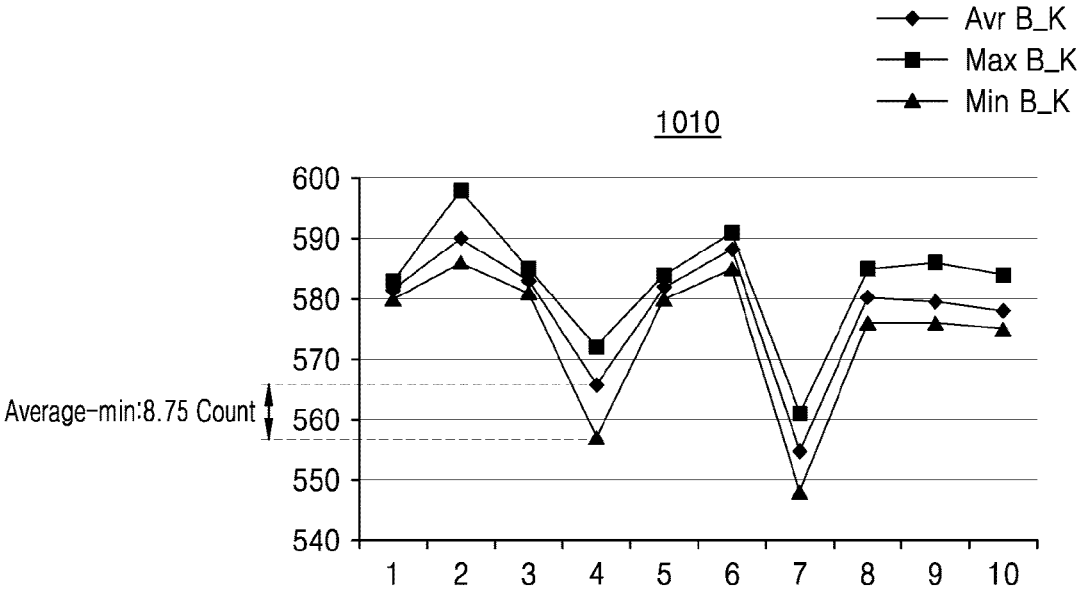
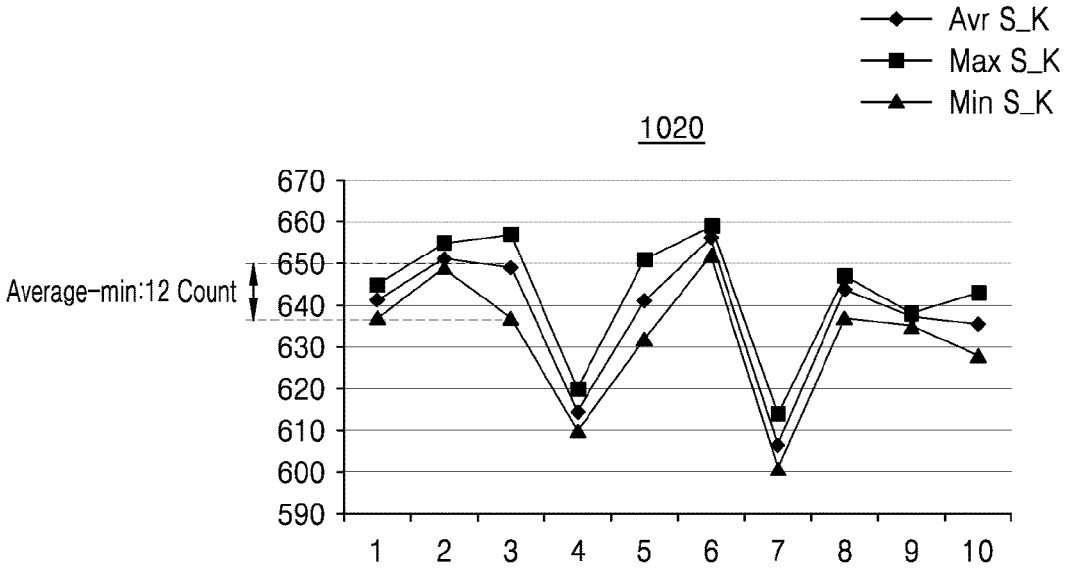

[Fig. 11]
| | Y offset (LEFT BASIS) | | |
|---|---|---|---|
| | CK | MK | YK |
| BEFORE 200 PIECES | 2 | −24 | −43 |
| AFTER 200 PIECES | 4 | 9 | −24 |
| BEFORE 400 PIECES | 11 | 20 | −16 |
| AFTER 400 PIECES | 6 | 17 | −31 |
| BEFORE 600 PIECES | 17 | 29 | −20 |
| AFTER 600 PIECES | −9 | −8 | −1 |
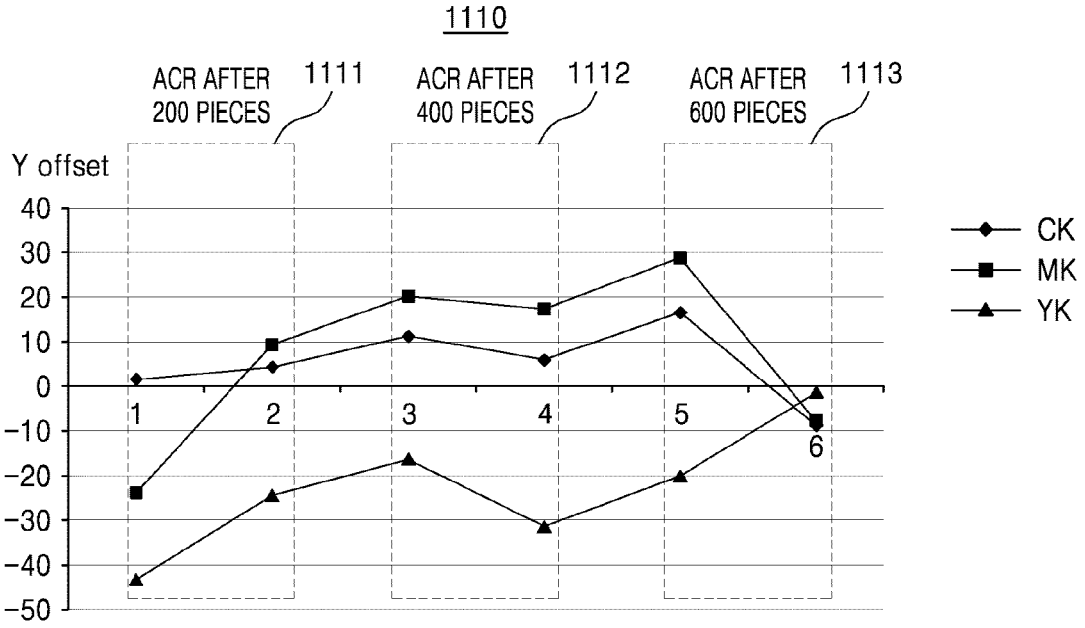

[Fig. 12]
| | X offset (LEFT BASIS) | | |
|---|---|---|---|
| | CK | MK | YK |
| BEFORE 200 PIECES | 16 | 22 | 4 |
| AFTER 200 PIECES | −16 | −24 | −14 |
| BEFORE 400 PIECES | −17 | −34 | −23 |
| AFTER 400 PIECES | −16 | −27 | −8 |
| BEFORE 600 PIECES | −17 | −35 | −16 |
| AFTER 600 PIECES | −1 | −35 | −13 |
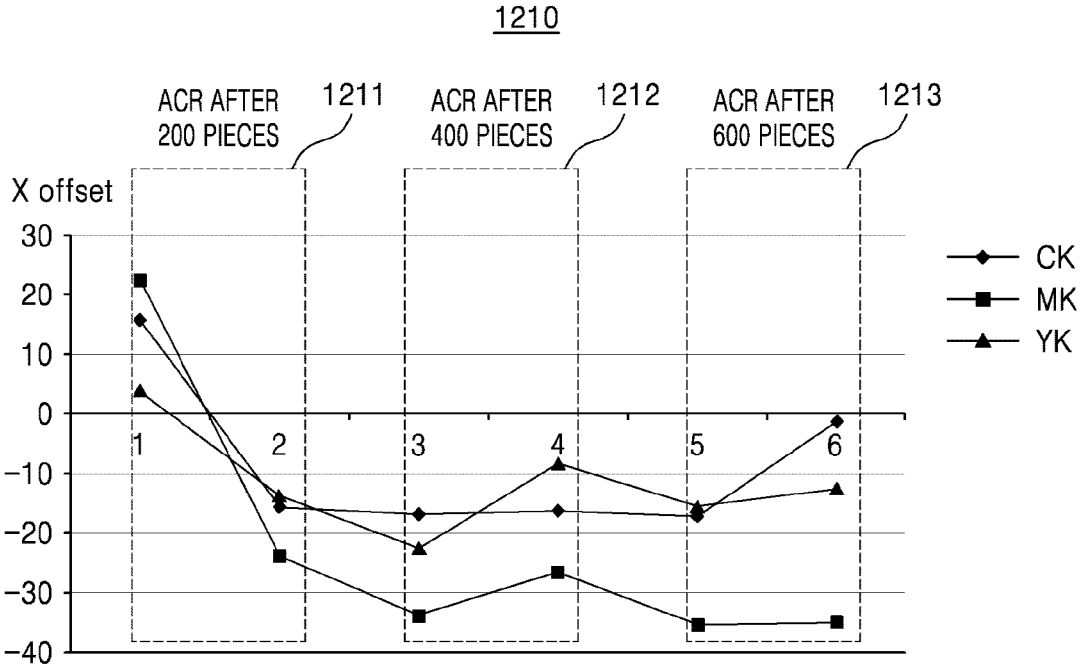

COLOR REGISTRATION USING NOISE FREE DATA

CROSS REFERENCE TO RELATED APPLICATIONS

This application is filed under 35 U.S.C. 0 371 as a National Stage of PCT International Application No. PCT/KR2018/012079, filed on Oct. 15, 2019, in the U.S. Patent and Trademark Office, which claims the priority benefit of Korean Patent Application No. 10-2018-0063013, filed on May 31, 2018, in the Korean Intellectual Property Office. The disclosures of PCT International Application No. PCT/KR2018/012079 and Korean Patent Application No. 10-2018-0063013 are incorporated by reference herein in their entireties.

BACKGROUND ART

Image forming apparatuses form an image on a recording medium such as paper through image forming processes such as charging, exposure, development, transfer, and fusing. In detail, image forming apparatuses print an image onto a recording medium by supplying a toner to an electrostatic latent image formed on a photoconductor to form a visible toner image on the photoconductor, transferring the toner image onto the recording medium, and fusing the transferred toner image to the recording medium.

BRIEF DESCRIPTION OF DRAWINGS

The above and other aspects, features, and advantages of certain examples of the present disclosure will be more apparent from the following description taken in conjunction with the accompanying drawings where reference numerals denote structural elements, in which:

FIG. 1 is a diagram for explaining a schematic structure and operations of an image forming apparatus according to an example;

FIG. 2 is a block diagram illustrating configurations of an image forming apparatus according to an example;

FIG. 3 is a flowchart for explaining an operation method of an image forming apparatus for obtaining standard patch data, which is a result of removing noise data from patch data corresponding to a color registration pattern, and performing color registration using the standard patch data, according to an example;

FIG. 4 is a diagram for explaining a process in which, when an intermediate transfer body has noise inserted between patches, an image forming apparatus obtains patch data and obtains standard patch data, which is a result of removing noise data from the patch data, according to an example;

FIG. 5 is a diagram for explaining a process in which, when an intermediate transfer body has noise inserted between patches, noise data is detected from patch data, according to an example;

FIG. 6 is a diagram for explaining a process in which, when an intermediate transfer body has noise overlapping patches, an image forming apparatus obtains patch data and obtains standard patch data, which is a result of removing noise data from the patch data, according to an example;

FIG. 7 is a graph showing a waveform of patch data including noise data when an intermediate transfer body has noise overlapping patches, according to an example;

FIG. 8 is a diagram for explaining a process in which, when an intermediate transfer body has noise overlapping patches, virtual data is generated in a region including noise data to obtain standard patch data in which the noise data has been removed, according to an example;

FIG. 9 is a graph showing a waveform of patch data having noise data removed, according to an example;

FIG. 10 is a graph for displaying a maximum, a minimum, and an average of a distance between black colors which are measured when color registration is performed, according to an example;

FIG. 11 is a graph for comparing Y offset values of an image before and after automatic color registration is performed by an image forming apparatus, according to an example; and FIG. 12 is a graph for comparing X offset values of an image before and after automatic color registration is performed by an image forming apparatus, according to an example.

MODE FOR THE INVENTION

As used herein, the term "and/or" includes any and all combinations of one or more of the associated listed items. Expressions such as "at least one of," when preceding a list of elements, modify the entire list of elements and do not modify the individual elements of the list.

An "image forming apparatus" may denote any type of apparatus capable of performing an image forming job, such as a printer, a scanner, a fax machine, a multifunction printer (MFP), or a display apparatus. Also, "print data" may denote data converted to a format printable by a printer. Also, a "scan file" may denote a file generated by scanning an image via a scanner.

Examples of the disclosure will now be described more fully with reference to the accompanying drawings for those of ordinary skill in the art to be able to perform the disclosure without any difficulty. However, the disclosure may have different forms and is not limited to the examples set for herein.

FIG. 1 is a diagram for explaining a schematic structure and operations of an image forming apparatus 100 according to an example.

The image forming apparatus 100 may print a color image by using an electrophotographic development method. Referring to FIG. 1, the image forming apparatus 100 may include a plurality of developing devices 10, an exposure device 50, a transfer unit, and a fuser 80.

The image forming apparatus 100 may further include a plurality of developer cartridges 20 containing developers. The plurality of developer cartridges 20 may be respectively connected to the plurality of developing devices 10, and developers contained in the plurality of developer cartridges 20 may be respectively supplied to the plurality of developing devices 10. The plurality of developer cartridges 20 and the plurality of developing devices 10 are detachable from a body 1 and may be individually replaced.

The plurality of developing devices 10 may form toner images with cyan (C) color, magenta (M) color, yellow (Y) color, and black (K) color. The plurality of developer cartridges 20 may respectively contain developers with cyan (C) color, magenta (M) color, yellow (Y) color, and black (K) color for supply to the plurality of developing devices 10. However, the disclosure is not limited thereto, and the image forming apparatus 100 may further include developer cartridges 20 and developing devices 10 for containing and developing developers with other various colors such as light magenta color and white color. Hereinafter, the image forming apparatus 100 including the plurality of developing devices 10 and the plurality of developer cartridges 20 will be described, and unless there is any other description, items with reference characters C, M, Y, and K indicate elements for developing developers with cyan color, magenta color, yellow color, and black color, respectively.

A developing device 10 may include a photoconductor 14 on which an electrostatic latent image is formed, and a developing roller 13 which supplies a developer to the electrostatic latent image to develop the electrostatic latent image into a visible toner image. A photoconductive drum is an example of the photoconductor 14 on which an electrostatic latent image is formed and may be an organic photoconductor (OPC) including a conductive metal pipe and a photoconductive layer formed at an outer circumference of the conductive metal pipe. A charging roller 15 is an example of a charger that charges a surface of the photoconductor 14 to have a uniform surface potential. Instead of the charging roller 15, a charging brush, a corona charger, or the like may be used.

The developing device 10 may further include a charging roller cleaner (not shown) for removing foreign substances, such as a developer or dust, attached to a surface of the charging roller 15, a cleaning member 17 for removing a developer remaining on a surface of the photoconductor 14 after an intermediate transfer process, and a regulating member (not shown) for regulating an amount of a developer to be supplied to a development region where the photoconductor 14 and the developing roller 13 face each other. A waste developer may be contained in a waste developer container 17*a*. The cleaning member 17 may be, for example, a cleaning blade that contacts a surface of the photoconductor 14 and rakes out a developer.

A developer contained in a developer cartridge 20 may be supplied to the developing device 10. The developer contained in the developer cartridge 20 may be a toner. Depending on a developing method, the developer may be a toner and a carrier. The developing roller 13 is separate from the photoconductor 14. A distance between an outer circumferential surface of the developing roller 13 and an outer circumferential surface of the photoconductor 14 may be, for example, tens of microns to hundreds of microns. The developing roller 13 may be a magnetic roller. Also, the developing roller 13 may have a magnet disposed in a rotary developing sleeve. In the developing device 10, the toner is mixed with the carrier, and the toner is attached to a surface of a magnetic carrier. The magnetic carrier may be attached to a surface of the developing roller 13 and be carried to a development region where the photoconductor 14 and the developing roller 13 face each other. The regulating member may regulate an amount of the developer to be carried to the development region. Only the toner is supplied to the photoconductor 14 by a developing bias voltage applied between the developing roller 13 and the photoconductor 14 to develop an electrostatic latent image formed on a surface of the photoconductor 14 into a visible toner image. Depending on a developing method, a surplus developer may be discharged to the outside of the developing device 10 to regularly maintain an amount of the developer in the developing device 10.

The exposure device 50 radiates light modulated in correspondence with image information to the photoconductor 14 and thus forms an electrostatic latent image on the photoconductor 14. Examples of the exposure device 50 may include a laser scanning unit (LSU) using a laser diode as a light source and a light-emitting diode (LED) exposure device using an LED as a light source.

The transfer device may transfer a toner image formed on the photoconductor 14 to a recording medium P. In the present example, an intermediate transfer technique transfer device may be used. For example, the transfer device may include an intermediate transfer body 60, an intermediate transfer roller 61, and a transfer roller 70.

An intermediate transfer belt is an example of the intermediate transfer body 60 to which toner images developed on photoconductors 14 of the plurality of developing devices 10 are transferred, and may temporarily contain the toner images. A plurality of intermediate transfer rollers 61 may be arranged in a position facing the photoconductors 14 of the plurality of developing devices 10 with the intermediate transfer body 60 therebetween. An intermediate transfer bias for intermediate-transferring toner images developed on the photoconductors 14 to the intermediate transfer body 60 may be applied to the plurality of intermediate transfer rollers 61. Instead of the intermediate transfer roller 61, a corona transfer device or a pin scorotron technique transfer device may be used.

The transfer roller 70 may face the intermediate transfer body 60. A transfer bias for transferring the toner images transferred to the intermediate transfer body 60 to the recording medium P may be applied to the transfer roller 70.

The fuser 80 may apply heat and/or pressure to the toner images transferred to the recording medium P and thus may fuse the toner images to the recording medium P. A form of the fuser 80 is not limited to the example shown in FIG. 1.

Through the above-described structure, the exposure device 50 may form electrostatic latent images on the photoconductors 14 by scanning a plurality of light beams to the photoconductors 14 of the plurality of developing devices 10, the plurality of light beams modulated according to image information of each color. Due to C, M, Y, and K developers supplied from the plurality of developer cartridges 20 to the plurality of developing devices 10, the electrostatic latent images of the photoconductors 14 of the plurality of developing devices 10 may be developed into visible toner images. The developed toner images may be sequentially intermediate-transferred to the intermediate transfer body 60. The recording medium P loaded on a paper feeder 90 may be transported along a paper feeding path 91 and be transported between the transfer roller 70 and the intermediate transfer body 60. The toner images intermediate-transferred on the intermediate transfer body 60 by the transfer bias voltage applied to the transfer roller 70 may be transferred to the recording medium P. When the recording medium P passes through the fuser 80, the toner images are fused to the recording medium P by heat and pressure. The recording medium P where fusing has been completed may be discharged by a discharge roller 92.

The developer cartridge 20 may supply a developer to the developing device 10. When the developer contained in the developer cartridge 20 is all consumed, the developer cartridge 20 may be replaced with a new developer cartridge 20, or the developer cartridge 20 may be charged with a new developer.

The image forming apparatus 100 may further include a developer supply unit 30. The developer supply unit 30 may receive a developer from the developer cartridge 20 and supply the developer to the developing device 10. The developer supply unit 30 is connected to the developing device 10 via a supply pipeline 40. Unlike that illustrated in FIG. 1, the developer supply unit 30 may be omitted, and the supply pipeline 40 may directly connect the developer cartridge 20 to the developing device 10.

FIG. 2 is a block diagram illustrating configurations of the image forming apparatus 100 according to an example.

The image forming apparatus 100 shown in FIG. 2 may include the photoconductor 14, the developing device 10, the intermediate transfer body 60, a sensor 65, and a processor 120. However, not all of the components shown in FIG. 2 are essential components. The image forming apparatus 100 may be realized by components more than those illustrated in FIG. 2 or may be realized by components fewer than those illustrated in FIG. 2. Hereinafter, the above-described components will be described.

The developing device 10 may form a toner image on the photoconductor 14 by supplying a developer to the photoconductor 14. A plurality of developing devices 10 and a plurality of photoconductors 14 may be provided, and the number of developing devices 10 and photoconductors 14 is related to the number of colors of developers. For example, when developers that are used in the image forming apparatus 100 have a total of four colors, that is, cyan (C) color, magenta (M) color, yellow (Y) color, and black (K) color, there may be the developing device 10 and the photoconductor 14 corresponding to each color, and thus, there may be four developing devices 10 and four photoconductors 14.

The toner image formed on the photoconductor 14 may be transferred to the intermediate transfer body 60. Not only a toner image to be output to a recoding medium such as paper but also a color registration pattern for color registration may be transferred to the intermediate transfer body 60. Color registration means correctly overlapping primary color images respectively provided from the plurality of developer cartridges 20 to obtain a complete color image. The color registration pattern is a test pattern that is formed by the image forming apparatus 100 for accurate color registration and may be used to detect various types of image misalignment which may occur in the image forming apparatus 100.

The sensor 65 may sense color registration patterns transferred on the intermediate transfer body 60. A plurality of sensors 65 may be provided to correspond to the color registration patterns, respectively. The sensor 65 may collinearly face a main scanning direction of the intermediate transfer body 60 and thus may respectively sense the color registration patterns in a position collinearly corresponding to the main scanning direction of the intermediate transfer body 60.

The processor 120 may control overall operations of the image forming apparatus 100 and may include at least one processor such as a central processing unit (CPU). The processor 120 may include at least one specialized processor corresponding to each function or may be an integrated-type processor.

The processor 120 may control the intermediate transfer body 60 such that developers with a plurality of colors may each be transferred to the intermediate transfer body 60 according to the color registration pattern. The color registration pattern may be a standard for determining overlapping information of respective primary color images of the plurality of colors to form a complete color image through an image forming job.

The processor 120 may obtain, via the sensor 65, patch data including patch values of patches of each of the plurality of colors transferred on the intermediate transfer body 60 according to the color registration pattern. For example, a patch value of a patch of a first color may be at least one of a value indicating a distance between patches of the first color and a value reflected from the patch of the first color. That is, the patch value of the patch of the first color may be a value for a certain parameter that may be obtained from the patch of the first color transferred to the intermediate transfer body 60.

In detail, the processor 120 may obtain, via the sensor 65, patch data including patch values corresponding to color patches transferred on the intermediate transfer body 60 according to the color registration pattern. A patch value is a characteristic value that may be obtained from a patch or patches. Particularly, the processor 120 may obtain, via the sensor 65, patch data including patch values of patches of each of the plurality of colors. For example, a patch value of a patch of a first color may be at least one of a value indicating a distance between patches of the first color and an optical characteristic value reflected from the patch of the first color. That is, the patch value of the patch of the first color may be a value for a certain factor or parameter that may be obtained from the patch of the first color transferred to the intermediate transfer body 60.

The processor 120 may compare the patch data with reference patch data corresponding to the color registration pattern, and based on a comparison result, may detect noise data including noise from the patch data. In this regard, the reference patch data is data which is compared with patch data and may be used to detect noise data within the patch data. The processor 120 may obtain standard patch data by removing the noise data from the patch data, and based on the standard patch data, may perform color registration.

For example, the processor 120 may compare expected patch values expected and obtained as patches of each of the plurality of colors within patch data with reference patch values of reference patches of each of the plurality of colors within reference patch data according to an arranged sequence. When a difference between a first expected patch value, from among the expected patch values, corresponding to a certain sequence and a first reference patch value, from among the reference patch values, corresponding to the certain sequence is beyond a certain range, the processor 120 may detect the first expected patch value as noise data. In this regard, a patch value of a color may be information indicating a distance between patches of the color.

The processor 120 may obtain patch data that is more than reference patch data by as much as data detected as noise data or greater. The processor 120 may remove noise data from the patch data and thus may obtain data filtered as much as reference patch data as standard patch data. That is, even though noise data is removed from patch data, patch values of a patch of a color are included, and thus, the image forming apparatus 100 may obtain standard patch data corresponding to reference patch data. A method in which, when the intermediate transfer body 60 has noise inserted between patches, the image forming apparatus 100 detects and removes noise data from patch data will be described with reference to FIGS. 4 and 5.

In another example, the processor 120 may obtain a first waveform indicating expected patch values expected and obtained as patches of each of the plurality of colors according to time, based on patch data. In addition, the processor 120 may obtain a second waveform indicating reference patch values of each of the plurality of colors according to time, based on reference patch data. The processor 120 may compare the first waveform with the second waveform, and based on a comparison result, may determine a distorted region of the first waveform. The processor 120 may detect data corresponding to the distorted region as noise data.

In detail, the processor 120 may determine a region where a normal pattern resulting from patch values of patches of each of the plurality of colors within reference patch data does not match a pattern resulting from the expected patch values detected from a masking region in the first waveform as the distorted region.

The processor 120 may remove the data corresponding to the distorted region from the patch data and may obtain the remaining patch data as standard patch data.

In addition, the processor 120 may obtain an average distance of a normal pattern of a first color corresponding to the distorted region in a region of the first waveform having no distortion. The processor 120 may generate virtual data based on the average distance of the normal pattern of the first color in the distorted region of the first waveform. The processor 120 may obtain patch data in which the virtual data is reflected as standard patch data. A method in which, when the intermediate transfer body 60 has noise overlapping patches, the image forming apparatus 100 detects and removes noise data from patch data will be described with reference to FIGS. 6 to 9.

By performing color registration using data having noise removed, the processor 120 may accurately perform color registration, and may increase quality of an image generated through an image forming job.

The processor 120 may compare standard patch data with reference patch data and may detect first error data of the first color having an error from the standard patch data. The processor 120 may generate first calibration data of the first color so that the first error data may match first reference data corresponding to the first error data. The processor 120 may calibrate overlapping information of a primary color image of the first color and a primary color image of a second color, based on the first calibration data.

The processor 120 may determine a contamination level of the intermediate transfer body 60, based on a frequency of noise data and the number of items of noise data within patch data. For example, when the number of items of noise data detected according to the color registration pattern having 1 cycle is equal to or greater than a certain number, the image forming apparatus 100 may determine the contamination level of the intermediate transfer body 60 as high. When the contamination level of the intermediate transfer body 60 is beyond a range of a preset contamination level, the processor 120 may output information giving notification about replacement of the intermediate transfer body 60. For example, the processor 120 may transmit a message giving notification about replacement of the intermediate transfer body 60 to a server managing the image forming apparatus 100 or a terminal of a user of the image forming apparatus 100 via a communication apparatus (not shown) in the image forming apparatus 100. In addition, the processor 120 may display a message giving notification about replacement of the intermediate transfer body 60 via a display (not shown) in the image forming apparatus 100.

When a cause of noise data detected is noise inserted between patches of each of the plurality of colors transferred to the intermediate transfer body 60, the processor 120 may obtain patch data including patch values of patches of each of the plurality of colors by decreasing a width of a masking region where the patch values of patches of each of the plurality of colors are obtained.

The image forming apparatus 100 may further include a memory (not shown). The memory (not shown) may store a program, data, or a file related to the image forming apparatus 100. The processor 120 may execute a program stored in the memory (not shown), may read data or a file stored in the memory (not shown), or may store a new file in the memory (not shown). The memory (not shown) may store a program command, a data file, a data structure, etc. individually or in a combination. The memory (not shown) may store instructions executable by the processor 120.

For example, the memory (not shown) may store instructions of transferring respective developers with a plurality of colors to the intermediate transfer body 60 according to a color registration pattern, instructions of obtaining patch data including patch values of patches of each of the plurality of colors transferred on the intermediate transfer body 60 according to the color registration pattern, instructions of comparing the patch data with reference patch data corresponding to the color registration data and detecting, based on a comparison result, noise data including noise from the patch data, and instructions of obtaining standard patch data by removing the noise data from the patch data and performing color registration based on the standard patch data.

Hereinafter, various operations or applications of the image forming apparatus 100 will be described, and even though an element from among the photoconductor 14, the developing device 10, the intermediate transfer body 60, the sensor 65, the processor 120, the communication apparatus (not shown), the display (not shown), and the memory (not shown) is not specified, the contents that one of ordinary skill in the art is able to clearly understand and expect may be understood as ordinary implementation, and claims of the disclosure are not limited to a name or a physical/logical structure of a certain element.

FIG. 3 is a flowchart for explaining an operation method of an image forming apparatus for obtaining standard patch data, which is a result of removing noise data from patch data corresponding to a color registration pattern and performing color registration using the standard patch data, according to an example.

In operation 310, the image forming apparatus 100 may transfer respective developers with a plurality of colors to the intermediate transfer body 60 according to a color registration pattern. The color registration pattern may be a standard for determining overlapping information of respective primary color images of the plurality of colors to form a complete color image through an image forming job.

In operation 320, the image forming apparatus 100 may obtain patch data including patch values of patches of each of the plurality of colors transferred on the intermediate transfer body 60 according to the color registration pattern. A patch value is a characteristic value that may be obtained from a patch or patches. For example, a patch value of a patch of a first color may be at least one of a value indicating a distance between patches of the first color and an optical characteristic value reflected from the patch of the first color.

In operation 330, the image forming apparatus 100 may compare the patch data with reference patch data corresponding to the color registration data. The image forming apparatus 100 may detect noise data including noise from the patch data, based on a comparison result.

In operation 340, the image forming apparatus 100 may obtain standard patch data by removing the noise data from the patch data. The image forming apparatus 100 may perform color registration based on the standard patch data.

FIG. 4 is a diagram for explaining a process in which, when an intermediate transfer body has noise inserted between patches, an image forming apparatus obtains patch data and obtains standard patch data, which is a result of removing noise data from the patch data, according to an example.

As shown in FIG. 4, the image forming apparatus 100 may transfer respective developers with a plurality of colors to the intermediate transfer body 60 according to a color registration pattern. When the intermediate transfer body 60 has noise inserted between patches, noise data does not distort patch data indicating patch values of patches. However, when the noise data is recognized as patch data, the image forming apparatus 100 may not accurately perform color registration.

In detail, the intermediate transfer body 60 may have a scratch on its surface due to an image forming job. Subsequently, the scratch on the surface of the intermediate transfer body 60 may serve as noise in performing an image forming job. The sensor 65 in the image forming apparatus 100 may recognize the scratch on the surface of the intermediate transfer body 60 as a patch having a color developer transferred to the intermediate transfer body 60. That is, the sensor 65 in the image forming apparatus 100 may recognize the scratch on the surface of the intermediate transfer body 60 as a certain patch and thus may obtain a value corresponding to the scratch as patch data.

In addition, the sensor 65 in the image forming apparatus 100 may obtain patch data including patch values of patches of developers of the plurality of colors transferred according to the color registration pattern to perform color registration.

For example, the number of reference patches according to a pattern of color registration is N. Then, the number of patches corresponding to the reference patches should also be N to perform color registration. As shown in FIG. 4, the intermediate transfer body 60 has first noise 401 and second noise 402. When the image forming apparatus 100 obtains patch values of patches corresponding to the reference patches as many as N in a sensing sequence of the sensor 65 to perform color registration, patch data including noise data may be obtained. That is, the image forming apparatus 100 may obtain N−2 patch values and first noise data and second noise data resulting from the first noise 401 and the second noise 402. In this case, due to the first noise data and the second noise data, patch values of two missing patches 403 are not included in patch data. Accordingly, the image forming apparatus 100 may obtain patch data more than noise data. When the number of noise data is 2, the image forming apparatus 100 may obtain patch data including N+2 or more patch values.

FIG. 5 is a diagram for explaining a process in which, when an intermediate transfer body has noise inserted between patches, noise data is detected from patch data, according to an example.

The image forming apparatus 100 may compare expected patch values expected and obtained as patches of each of a plurality of colors within patch data with reference patch values of reference patches of each of the plurality of colors within reference patch data according to an arranged sequence.

When a difference between a first expected patch value, from among expected patch values, corresponding to a certain sequence and a first reference patch value, from among reference patch values, corresponding to the certain sequence is beyond a certain range, the image forming apparatus 100 may detect the first expected patch value as noise data.

For example, reference patch data corresponding to color registration may include a first reference patch value 501 indicating a distance between a black patch 511 and a black patch 516, a second reference patch value 502 indicating a distance between a cyan patch 512 and a cyan patch 517, a third reference patch value 503 indicating a distance between a magenta patch 513 and a magenta patch 518, and a fourth reference patch value 504 indicating a distance between a yellow patch 514 and a yellow patch 519.

To perform color registration, patch data corresponding to the reference patch data is required. The patch data requires a first patch value indicating an actual distance between the black patch 511 and the black patch 516, which is detected by the sensor 65, a second patch value indicating an actual distance between the cyan patch 512 and the cyan patch 517, a third patch value indicating an actual distance between the magenta patch 513 and the magenta patch 518, and a fourth patch value indicating an actual distance between the yellow patch 514 and the yellow patch 519. Accordingly, the image forming apparatus 100 may obtain patch data including four or more patch values.

As shown in FIG. 5, in the intermediate transfer body 60, there is a noise patch 515 between bar-shaped color patches and slant color patches. A distance between the bar-shaped color patches may be d (μm) (d>0). A distance between the slant color patches may be d (μm) (d>0). A distance between a bar-shaped yellow patch and a slant black patch may be 2d (μm) (d>0).

The sensor 65 of the image forming apparatus 100 may obtain patch values of the bar-shaped color patches and patch values of the slant color patches and may also obtain a patch value of a noise patch 515.

The image forming apparatus 100 may obtain expected patch values 505, 506, 507, 508, and 509 expected and obtained as patches of each of a plurality of colors within patch data. The expected patch values 505, 506, 507, 508, and 509 may include a first expected patch value 505 indicating a distance between the black patch 511 and the noise patch 515, a second expected patch value 506 indicating a distance between the black patch 511 and the black patch 516, a third expected patch value 507 indicating a distance between the cyan patch 512 and the cyan patch 517, a third expected patch value 508 indicating a distance between the magenta patch 513 and the magenta patch 518, and a fourth patch value 509 indicating an actual distance between the yellow patch 514 and the yellow patch 519.

A difference between the first expected patch value 505 indicating an actual distance between the black patch 511 and the noise patch 515 and the first reference patch value 501 indicating a distance between the black patch 511 and the black patch 516 may be d (μm) (d>0). A difference between the second expected patch value 506 indicating an actual distance between the black patch 511 and the black patch 516 and the first reference patch value 501 indicating a distance between the black patch 511 and the black patch 516 may be equal to or less than d/4 (μm) (d>0). The image forming apparatus 100 may compare the difference between the first expected patch value 505 and the first reference patch value 501 with the difference between the second expected patch value 506 and the first reference patch value 501 and thus may detect the first expected patch value 505 as noise data.

The image forming apparatus 100 may remove the first expected patch value 505 detected as noise data and may perform color registration based on the second expected patch value 506 indicating a distance between the black patch 511 and the black patch 516, the third expected patch value 507 indicating a distance between the cyan patch 512 and the cyan patch 517, the third expected patch value 508 indicating a distance between the magenta patch 513 and the magenta patch 518, and the fourth patch value 509 indicating an actual distance between the yellow patch 514 and the yellow patch 519.

FIG. 6 is a diagram for explaining a process in which, when an intermediate transfer body has noise overlapping patches, an image forming apparatus obtains patch data and obtains standard patch data, which is a result of removing noise data from the patch data, according to an example.

As shown in FIG. 6, the image forming apparatus 100 may transfer respective developers with a plurality of colors to the intermediate transfer body 60 according to a color registration pattern. When the intermediate transfer body 60 has noise 601 overlapping patches, noise data may distort patch data indicating patch values of the patches.

For example, the image forming apparatus 100 may compare patch data with reference patch data, and based on a comparison result, may detect noise data including noise from the patch data. In another example, when patch data including noise is denoted by a waveform, a pattern of a region including noise may be different from that of a region where there is no noise. The image forming apparatus 100 may determine a region having a rapidly changing pattern as including noise and may detect noise data from the patch data.

The image forming apparatus 100 may detect regions 602, 603, and 604 of the patches where patch data is distorted due to noise.

The image forming apparatus 100 may remove data corresponding to a distorted region from the patch data and may obtain remaining patch data as standard patch data.

FIG. 7 is a graph showing a waveform of patch data including noise data when an intermediate transfer body has noise overlapping patches, according to an example.

As shown in FIG. 7, the image forming apparatus 100 may obtain a first waveform indicating expected patch values expected and obtained as patches of each of a plurality of colors according to time, based on patch data.

In addition, the image forming apparatus 100 may obtain a second waveform indicating reference patches of each of the plurality of colors according to time, based on reference patch data. The image forming apparatus 100 may compare the first waveform with the second waveform, and based on a comparison result, may determine a distorted region in the first waveform. The image forming apparatus 100 may detect data corresponding to the distorted region as noise data.

In detail, the image forming apparatus 100 may determine regions 701, 702, 703, and 704 where a normal pattern caused by patch values of patches of each of the plurality of colors within reference patch data does not match a pattern caused by expected patch values detected from a masking region in the first waveform as distorted regions.

FIG. 8 is a diagram for explaining a process in which, when an intermediate transfer body has noise overlapping patches, virtual data is generated in a region including noise data to obtain standard patch data in which the noise data has been removed, according to an example.

As shown in FIG. 8, the image forming apparatus 100 may obtain patch values of patches within a masking region 801 via the sensor 65. The image forming apparatus 100 may obtain a first waveform 802 indicating patch values according to time from patch data obtained by the sensor 65. The first waveform 802 may be obtained based on edges of the patches detected within the masking region 801.

In the case of a color patch having no noise according to a color registration pattern, a waveform of a normal pattern having a certain pattern within a masking region may be obtained. However, when noise overlaps a color patch, the color patch may not be accurately detected within the masking region, and only the top or bottom of the color patch may be detected. Accordingly, a waveform for the color patch overlapped by noise may have a different pattern from the waveform of a normal pattern.

The image forming apparatus 100 may obtain, in a region of the first waveform 802 having no distortion, an average distance 803 of a normal pattern of a first color corresponding to a distorted region. The image forming apparatus 100 may generate virtual data 804 based on the average distance 803 of a normal pattern of a first color in the distorted region of the first waveform 802. The image forming apparatus 100 may obtain patch data in which the virtual data 804 is reflected as standard patch data.

FIG. 9 is a graph showing a waveform of patch data having noise data removed, according to an example.

The image forming apparatus 100 may obtain standard patch data by removing noise data from patch data. Referring to FIG. 9, the image forming apparatus 100 may obtain a waveform indicating patch values of patches of each of a plurality of colors according to time based on standard patch data.

In the distorted regions 701, 702, 703, and 704 of the first waveform shown in FIG. 7, the image forming apparatus 100 may generate virtual data based on a distance of a normal pattern of a color corresponding to the distorted regions 701, 702, 703, and 704. The image forming apparatus 100 may obtain standard patch data in which the virtual data is reflected. In a waveform for the standard patch data, the distorted regions 701, 702, 703, and 704 of the first waveform shown in FIG. 7 may be calibrated into regions 901, 902, 903, and 904 having no distortion.

FIG. 10 is a graph for displaying a maximum, a minimum, and an average of a distance between black colors which are measured when color registration is performed, according to an example.

In the graph of FIG. 10, a horizontal axis denotes information about a round at which color registration is performed, and a vertical axis denotes information about a distance between patches of each color.

A graph 1010 of FIG. 10 shows information about a distance between bar-shaped black patches according to information about a round at which color registration is performed. In addition, a rhombus denotes information about an average distance between bar-shaped black patches, a square denotes information about a maximum distance between bar-shaped black patches, and a triangle denotes information about a minimum distance between bar-shaped black patches.

As shown in FIG. 10, a round at which a difference between an average distance between bar-shaped black patches and a maximum distance or minimum distance between bar-shaped black patches is largest in the graph 1010 is the fourth round. Particularly, a difference between the average distance between bar-shaped black patches and the minimum distance between bar-shaped black patches is 8.75 counts. In this regard, when 8.75 counts is represented in dots, 8.75 counts is 0.315 dots.

In addition, a graph 1020 of FIG. 10 shows information about a distance between slant black patches according to information about a round at which color registration is performed. In addition, a rhombus denotes information about an average distance between slant black patches, a square denotes information about a maximum distance between slant black patches, and a triangle denotes information about a minimum distance between slant black patches.

As shown in FIG. 10, a round at which a difference between an average distance between slant black patches and a maximum distance or minimum distance between slant black patches is largest in the graph 1020 is the third round. Particularly, a difference between the average distance between slant black patches and the minimum distance between slant black patches is 12 counts. In this regard, when 12 counts is represented in dots, 12 counts is 0.429 dots.

Accordingly, when the image forming apparatus 100 generates virtual data based on an average distance between patches of a first color corresponding to a noise region, a difference from an actual distance between patches of the first color is not large (for example, within 0.315 dots, 0.429 dots) even if the average distance between patches of the first color were used. Thus, even when the average distance between patches of the first color corresponding to the noise region is used, the same effect when the actual distance between patches of the first color is used may be obtained.

FIG. 11 is a graph for comparing Y offset values of an image before and after automatic color registration (ACR) performed by an image forming apparatus, according to an example.

FIG. 11 is a graph 1110 showing offset values in a Y-axis direction obtained before and after ACR, which is performed whenever image formation is performed for every 200 pieces according to an image forming job in the image forming apparatus 100.

In detail, a region 1111 in the graph 1110 denotes offset values in the Y-axis direction obtained before and after image formation is performed for 200 pieces and ACR is performed. A region 1112 in the graph 1110 denotes offset values in the Y-axis direction obtained before and after image formation is performed for 400 pieces and ACR is performed. In addition, a region 1113 in the graph 1110 denotes offset values in the Y-axis direction obtained before and after image formation is performed for 600 pieces and ACR is performed.

Referring to the graph 1110 and a table of Y offset values corresponding to the graph 1110, as a result of the image forming apparatus 100 performing image formation for 200 pieces and 600 pieces, progressing ACR, and performing ACR, Y offset values decrease, and accordingly, the image forming apparatus 100 may perform a more precise image forming job.

FIG. 12 is a graph for comparing X offset values of an image before and after ACR performed by an image forming apparatus, according to an example.

FIG. 12 is a graph 1210 showing offset values in an X-axis direction obtained before and after ACR, which is performed whenever image formation is performed for every 200 pieces according to an image forming job in the image forming apparatus 100.

In detail, a region 1211 in the graph 1210 denotes offset values in the X-axis direction obtained before and after image formation is performed for 200 pieces and ACR is performed. A region 1212 in the graph 1210 denotes offset values in the X-axis direction obtained before and after image formation is performed for 400 pieces and ACR is performed. In addition, a region 1213 in the graph 1210 denotes offset values in the X-axis direction obtained before and after image formation is performed for 600 pieces and ACR is performed.

Referring to the graph 1210 and a table of X offset values corresponding to the graph 1210, as a result of the image forming apparatus 100 performing image formation for 200 pieces and 600 pieces, progressing ACR, and performing ACR, X offset values decrease, and accordingly, the image forming apparatus 100 may perform a more precise image forming job.

The above-described operation methods of the image forming apparatus 100 may be realized in a form of a computer-readable recording medium storing instructions executable by a computer or a processor or data. The above-described examples may be written as computer-executable programs and may be implemented in general-use digital computers that execute such programs by using a computer-readable recording medium. Examples of the computer-readable recording medium may include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, a magnetic tape, a floppy disk, a magneto-optical data storage device, an optical data storage device, a hard disk, a solid-state disk (SSD), and any device capable of storing an instruction or software, related data, a data file, and data structures and providing the instruction or software, the related data, the data file, and the data structures to a processor or a computer to allow the processor or the computer to execute instructions.

While the disclosure has been particularly shown and described with reference to examples thereof, it will be understood by those of ordinary skill in the art that various changes and modifications may be made therein. For example, an appropriate result may be attained even when the above-described techniques are performed in a different order from the above-described method and/or components, such as the above-described system, structure, apparatus, and circuit, are coupled or combined in a different form from the above-described methods or are substituted with or replaced by other components or equivalents thereof.

Therefore, the scope of the disclosure should not be limited to the examples described herein and is to be defined by the appended claims and equivalents thereof.

The invention claimed is:

1. An operation method of an image forming apparatus, the operation method comprising:

transferring developers corresponding to a plurality of colors, respectively, onto an intermediate transfer body to form a color registration pattern including patches of the plurality of colors, the color registration pattern to be used in testing a degree of an overlap of the plurality of colors in forming a color image;

obtaining patch data of the patches of the plurality of colors of included in the formed color registration pattern;

generating noise data indicative of noise in the formed color registration pattern, based on a comparison of the patch data of the patches with reference patch data of reference patches, the comparison including:

comparing a first waveform based on the patch data of the patches with a second waveform based on the reference patch data of the reference patches, and based on a result of the comparing, determining a distorted region in the first waveform and detecting data corresponding to the distorted region as the noise data; and obtaining standard patch data according to a removal of the noise data from the patch data, the standard patch data to be based on to perform a color registration.

2. The operation method of claim 1, wherein, the obtained patch data include respective expected patch values corresponding to the first waveform based on the patch data of the patches of the plurality of colors of the formed color registration pattern;

the comparing the first waveform with the second waveform comprises comparing the expected patch values corresponding to the first waveform with respective reference patch values corresponding to the second wave form based on of the reference patch data of the reference patches of the plurality of colors; and the determining the distorted region and the detecting the data corresponding to the distorted region comprises, when a difference between a first expected patch value, from among the expected patch values corresponding to the first waveform, and a first reference patch value, from among the reference patch values corresponding to the second wave form, is beyond a range, detecting the first expected patch value as the data corresponding to the distorted region as the noise data.

3. The operation method of claim 1, wherein, the obtaining the standard patch data comprises, in response to a number of items included in the obtained patch data being more than a number of items included in the reference patch data, obtaining, as the standard patch data, a number of items of standard patch data filtered from the obtained number of items of patch data according to the removal of the noise data and matching the number of items of reference patch data.

4. The operation method of claim 1, wherein, the obtained patch data include respective expected patch values corresponding to the patches of the plurality of colors of the formed color registration pattern; and the comparison of the patch data with the reference patch data comprises:

comparing the first waveform indicating, based on the patch data, the expected patch values according to a time period with the second waveform indicating, based on respective reference patch values of the reference patches of the plurality of colors of the reference patch data according to the time period.

5. The operation method of claim 4, wherein the determining of the distorted region in the first waveform comprises determining, as the distorted region, a region where a normal pattern resulting from the reference patch values of the reference patches of the plurality of colors included in the reference patch data does not match a pattern resulting from the expected patch values in the first waveform.

6. The operation method of claim 4, wherein the obtaining of the standard patch data comprises:

obtaining, from the patch data, remaining patch data remaining after the removal of the noise data corresponding to the distorted region, as the standard patch data.

7. The operation method of claim 4, wherein the obtaining of the standard patch data according to the removal of the noise data from the patch data comprises:

obtaining, in a region of the first waveform having no distortion, an average distance between portions of the first waveform;

generating virtual data corresponding to the distorted region of the first waveform, based on the average distance; and obtaining the standard patch data in which the virtual data is reflected as the standard patch data.

8. The operation method of claim 1, further comprising performing the color registration by:

detecting, from the standard patch data, first data of a first color having a value different from a corresponding reference value in the reference patch data, from comparing the standard patch data with the reference patch data;

generating first calibration data of the first color enabling the first data to match first reference data corresponding to the first data; and based on the first calibration data, calibrating a degree of an overlap of an image of the first color and an image of a second color.

9. The operation method of claim 1, further comprising:

based on a frequency of the noise data and a number of items of the noise data based on the patch data, obtaining a contamination level of the intermediate transfer body; and when the contamination level of the intermediate transfer body is equal to or exceeding a reference contamination level, outputting information about the intermediate transfer body.

10. The operation method of claim 1, wherein, the obtained patch data include respective expected patch values corresponding to the patches of the plurality of colors of the formed color registration pattern; and the obtaining the patch data includes:

when a cause of the noise data is noise inserted between two patches of the patches of the plurality of colors of the formed color registration pattern on the intermediate transfer body, obtaining the patch data by decreasing a width of a masking region where the patch values of patches of the plurality of colors are to be obtained.

11. An image forming apparatus comprising:

a photoconductor;

a developing device to form a toner image on the photoconductor by supplying a developer to the photoconductor;

an intermediate transfer body onto which the toner image formed on the photoconductor is to be transferred;

a sensor to sense a color registration pattern formed on the intermediate transfer body, to obtain patch data of patches of a plurality of colors included in the formed color registration pattern; and a processor to:

compare the patch data with reference patch data of reference patches by comparing a first waveform based on the patch data of the patches with a second waveform based on the reference patch data of the reference patches and, based on a result of the comparing, determining a distorted region in the first waveform and detecting data corresponding to the distorted region as the noise data, generate noise data indicative of noise in the formed color registration pattern, based on the comparing of the patch data with the reference patch data, obtain standard patch data according to a removal of the noise data from the patch data, and perform color registration based on the standard patch data.

12. The image forming apparatus of claim 11, wherein, the obtained patch data include respective expected patch values corresponding to the first waveform based on the patch data of the patches of the plurality of colors of the formed color registration pattern; and the processor is to:

to compare the first waveform with the second waveform, compare the expected patch values corresponding to the first waveform with respective reference patch values corresponding to the second wave form based on of the reference patch data of the reference patches of the plurality of colors; and to determine the distorted region and detecting the data corresponding to the distorted region, when a difference between a first expected patch value, from among the expected patch values corresponding to the first waveform, and a first reference patch value, from among the reference patch values corresponding to the second wave form, in the sequence is beyond a range, detect the first expected patch value as the data corresponding to the distorted region as the noise data.

13. The image forming apparatus of claim 11, wherein, the obtained patch data include respective expected patch values corresponding to the patches of the plurality of colors of the formed color registration pattern; and the processor is to:

compare the first waveform indicating, based on the patch data, the expected patch values according to a time period with the second waveform indicating, based on respective patch values of the reference patches of the plurality of colors of the reference patch data according to the time period.

14. The image forming apparatus of claim 13, wherein the processor is to, to generate the standard patch data:

obtain, in a region of the first waveform having no distortion, an average distance between portions of the first waveform corresponding to patches of a color among the patches of the plurality of colors;

generate virtual data corresponding to the distorted region of the first waveform, v based on the average distance; and obtain the standard patch data, in which the virtual data is reflected.

15. A non-transitory computer-readable storage medium storing instructions executable by a processor, to control:

a transfer of developers corresponding to a plurality of colors, respectively, onto an intermediate transfer body to form a color registration pattern including patches of the plurality of colors, the color registration pattern to be used in testing a degree of an overlap of the plurality of colors in forming a color image;

obtaining patch data of the patches of the plurality of colors included in the formed color registration pattern;

generating noise data indicative of noise in the formed color registration pattern, based on a comparison of the patch data of the patches with reference patch data of reference patches, the comparison comprising:

comparing a first waveform based on the patch data of the patches with a second waveform based on the reference patch data of the reference patches, and based on a result of the comparing, determining a distorted region in the first waveform and detecting data corresponding to the distorted region as the noise data; and obtaining standard patch data according to a removal of the noise data from the patch data, the standard patch data to be based on to perform a color registration.

* * * * *